US005092131A

United States Patent [19]

Hattori et al.

[11] Patent Number: 5,092,131

[45] Date of Patent: Mar. 3, 1992

[54] GAS EXPANSION ENGINE

[75] Inventors: Hitoshi Hattori, Yokohama; Katumasa Araoka, Kawasaki, both of Japan

[73] Assignee: Kabushiki Kaisha Toshiba, Kawasaki, Japan

[21] Appl. No.: 654,893

[22] Filed: Feb. 13, 1991

[30] Foreign Application Priority Data

Feb. 14, 1990 [JP] Japan ..... 2-32685
Feb. 21, 1990 [JP] Japan ..... 2-40331

[51] Int. Cl.[5] ..... F25B 9/00
[52] U.S. Cl. ..... 62/6; 60/520
[58] Field of Search ..... 62/6; 60/520

[56] References Cited

U.S. PATENT DOCUMENTS 4,248,050 2/1981 Durenec ..... 62/6
4,372,128 2/1983 Sarcia ..... 62/6
4,550,571 11/1985 Bertsch ..... 62/6
4,796,430 1/1989 Malaker et al. ..... 62/6

FOREIGN PATENT DOCUMENTS 55-48232 12/1980 Japan .
57-8305 1/1982 Japan .
62-88809 4/1987 Japan .

*Primary Examiner*—Ronald C. Capossela
*Attorney, Agent, or Firm*—Oblon, Spivak, McClelland, Maier & Neustadt

[57] ABSTRACT

A gas expansion engine in a refrigerating cycle is disclosed and, in particular, a gas expansion engine is provided which includes a cylinder and piston to define a variable-capacity expansion chamber therebetween. The piston is reciprocably inserted into the cylinder and is coupled to a motion conversion mechanism through a piston rod. One ball-and-socket joint is provided at at least one of a location between the piston rod and the piston and a location between the piston rod and the motion conversion mechanism. A ball-and-socket joint comprises a first member having a spherical convex surface section, a second member having a spherically concave surface section fitted into the spherically convex surface section of the first member and providing a joint boundary area with the first member, a slide mechanism for slidably moving the first member or second member in a direction perpendicular to the axis of the piston in accordance with an outer force, and an elastic member for providing a pressure contact force on an area between the spherically convex surface section and the spherically concave surface section.

20 Claims, 8 Drawing Sheets

GAS EXPANSION ENGINE

BACKGROUND OF THE INVENTION

1. Field of the Invention

The present invention relates to a gas expansion engine for use in a refrigerating cycle and, in particular, to a gas expansion engine having a cylinder and piston to define a variable-capacity expansion chamber therebetween.

2. Description of the Related Art

It is known in the prior art that, in a refrigerating cycle using helium as a refrigerant, a gas expansion engine is extensively used to obtain a low-temperature helium gas through the adiabatic expansion of high-pressure helium gas. In a reciprocating type gas expansion engine, a helium gas is adiabatically expanded within a variable-capacity expansion chamber defined between a cylinder and a piston and, at that time, released energy is recovered in the form of electric energy.

In this type of gas expansion engine, a motion conversion mechanism is connected to the piston to convert the reciprocatory motion to a rotation motion. This motion conversion mechanism ensures a stable reciprocatory motion of the piston and a generator for energy recovery is driven through the motion conversion mechanism.

When the piston is moved within a predetermined distance relative to a top dead point, a high-pressure helium gas is fed into the expansion chamber through the operation of a gas supply valve mechanism. The piston, after being moved past the top dead point, is driven, by a high-pressure helium gas, toward a bottom dead point. The capacity of the expansion chamber is increased with the movement of the piston toward the bottom dead point, causing a drop in temperature and pressure of the helium gas through an adiabatic expansion. With the movement of the piston past the bottom dead point and then the starting movement of it toward the top dead point, the low-temperature helium gas in the expansion chamber is discharged through the operation of the discharge valve mechanism. When the piston is moved within a predetermined distance relative to the top dead point, the discharge valve mechanism stops its operation and the supply valve again is moved. Through such a cycle, the low-temperature helium gas is intermittently sent out from the expansion chamber. The energy released from the high-pressure gas through the adiabatic expansion is recovered via the generator.

In a gas expansion engine using a refrigerating cycle, it is desirable to stably maintain a predetermined performance for an extended period of time. It is, therefore, necessary to achieve a structure where no undue force is exercised on those contact surfaces or slide portions of each part in the engine.

However, those severe conditions as will be set out below are inflicted on the gas expansion engine in terms of its specific characteristic. In the gas expansion engine, if a mechanically sliding part or parts are lubricated by an oil, grease, etc., a refrigerant gas is contaminated and the refrigeranting efficiency is lowered. For this reason, a sealing ring and guide ring as provided between the cylinder and the piston are employed without using any lubricating materials. Such sealing and guide rings without the use of any lubricating materials are worn in a short period of time in the case where any undue sliding movement, such as a one-sided impact, occurs at the associated parts. In order to suppress the wear of the sealing and guide rings, it is necessary that the piston be moved while these rings are smoothly slidably moved under a predetermined pressure below an allowable limit.

In the aforementioned reciprocating type gas expansion engine, however, the piston reciprocable in the cylinder has to be connected to the aforementioned motion conversion mechanism. In order to suppress the wear of the sealing and guide rings, it is required that the axis of the cylinder be aligned with the axis of the reciprocating part with an accuracy of the order of a few micron meters. In general, however, such an assembly is very difficult to achieve and, in the conventional gas expansion engine, the sealing and guide rings are liable to be worn out in a short period of time, bailing to maintain the engine performance over an extended period of time.

Further, the gas expansion engine parts need to be operated in the aforementioned lubrication-less way and hence the number of sliding parts need to be decreased to a minimum possible extent. In particular, the gas supply valve mechanism is required to be of an impact contact type without involving any slide motion. The use of the impact contact type mechanism undergoes a ready deformation of its constituent parts upon impact contact. If this deformation occurs, the valve operation becomes unstable for a short period of time. it is, therefore, not possible to stably maintain the engine performance for an extended period of time in view of the above.

SUMMARY OF THE INVENTION

It is accordingly the object of the present invention to provide a reciprocatory type gas expansion engine which can ensure an enhanced durability of its constituent parts without requiring any high accuracy with which it is assembled and hence can stably maintain its given performance over an extended period of time.

According to one embodiment of the present invention, a piston which is reciprocably inserted into a cylinder is coupled via a piston rod to a motion conversion mechanism. A ball-and-socket joint is provided at least one of a location between the piston and a piston rod and a location between the piston rod and the motion conversion mechanism. The ball-and-socket joint comprises a first member having a spherically convex surface section, a second member having a spherically concave surface section conforming to the spherically convex surface section of the first member and providing a joint boundary area with the first member, a slide mechanism for allowing the first or the second member to be slidably moved in a direction perpendicular to the axis of the piston in accordance with an external force, and an elastic member for providing a pressure contact force to an area between the spherically convex and concave surface sections.

According to the present invention, the ball-and-socket joint can accommodate any displacement or tilt as produced between the axis of the cylinder and that of the reciprocating parts in the motion conversion mechanism. It is thus possible to move the piston along the surface of the cylinder, or the reciprocatory motion part along the motion conversion mechanism, without involving any undue force. It is possible to suppress the wear of the sealing and guide rings as provided between the piston and the cylinder. It is, therefore, possible to stably maintain a given engine performance over an extended period of time.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
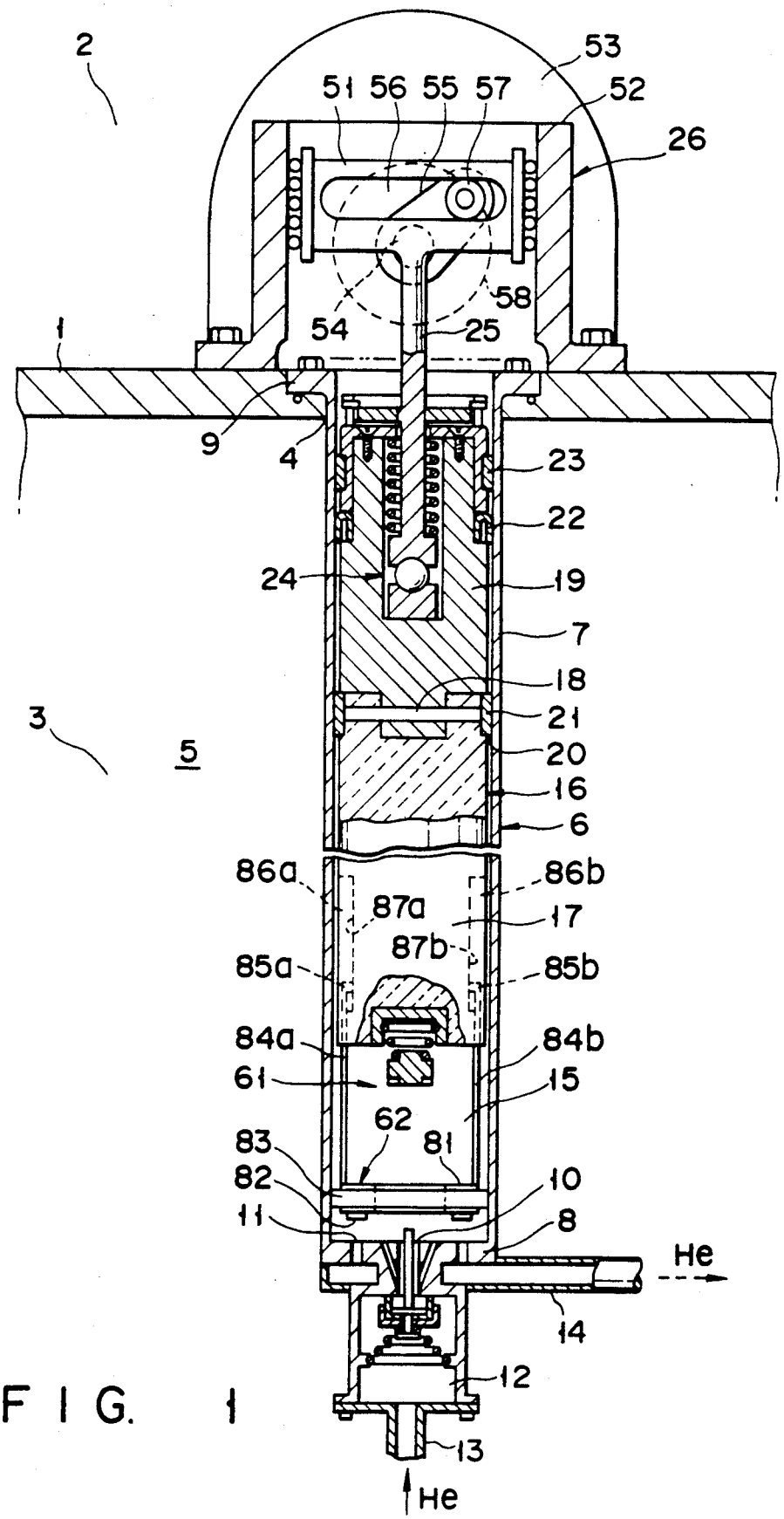
FIG. 1 is a view, in longitudinal cross-section, showing a gas expansion engine according to one embodiment of the present invention.

FIG. 1 shows a gas expansion engine according to one embodiment of the present invention.

In FIG. 1, reference numeral 1 shows a flange which serves as a partition wall for separating a vacuum adiabatic space 3 from an outer atmosphere 2. The flange 1 has a hole 4 via which a major section of a gas expansion engine 5 is inserted into the vacuum adiabatic space 3 in air-tight fashion. By so doing, the major section of the engine is mounted in the flange 1.

The gas expansion engine 5 includes a cylinder 6 formed of a metal having a small heat conductivity. The cylinder 6 comprises a cylindrical section 7, a head wall 8 closing one open end of the cylindrical section 7 and a flange portion 9 provided on the other open end of the cylindrical section 7 and outwardly extending in a radial direction of the cylindrical section 7. The cylinder 6 is inserted into the vacuum adiabatic space 3 via the hole 4 with the head wall 8 directed on the vacuum space side and with the flange portion 9 fixed to the flange 1 in a hermetically sealed fashion. A gas intake port 10 is formed at the central portion of the head wall 8 and extending through the head wall 8 in a direction of the thickness of the head wall 8. A plurality of gas discharge ports 11 are provided around the marginal edge portion of the head wall 8 in the direction of the thickness of the head wall 8. The gas intake port 10 communicate with a small chamber 12 provided outside the head wall 8. The small chamber 12 is connected via a gas guide pipe 13 to a high-pressure helium gas supply source, not shown. On the other hand, the gas discharge ports 11 lead to a low-temperature gas guide pipe 14 which is connected to a heat exchanger, not shown.

A piston 16 is reciprocably provided within the cylinder 6 with a capacity-varying expansion chamber 15 defined therebetween. The piston 16 comprises a cylindrical piston body 17 made of a phenolic resin of small heat conductivity and cylindrical metal block 19 serially connected by a pin 18 to the piston body 17. An annular groove 20 is provided at the outer periphery of a boundary area of the piston body 17 and metal block 19 and a guide ring 21 is provided in the annular groove 20 to allow the piston 16 to be moved along the inner surface of the cylinder 6. A packing type sealing ring 22, which prevents a leakage of a gas between the cylinder 6 and the piston 16, and a guide ring 23 are provided on the outer periphery of the metal block 19. The guide rings 21 and 23 and sealing ring 22 are formed of a self-lubricating material.

The metal block 19 is connected to a motion conversion mechanism 26 which converts a reciprocatory motion of the piston 16 to a rotation motion through a ball-and-socket joint 24 and piston rod 25.

Figure 2:
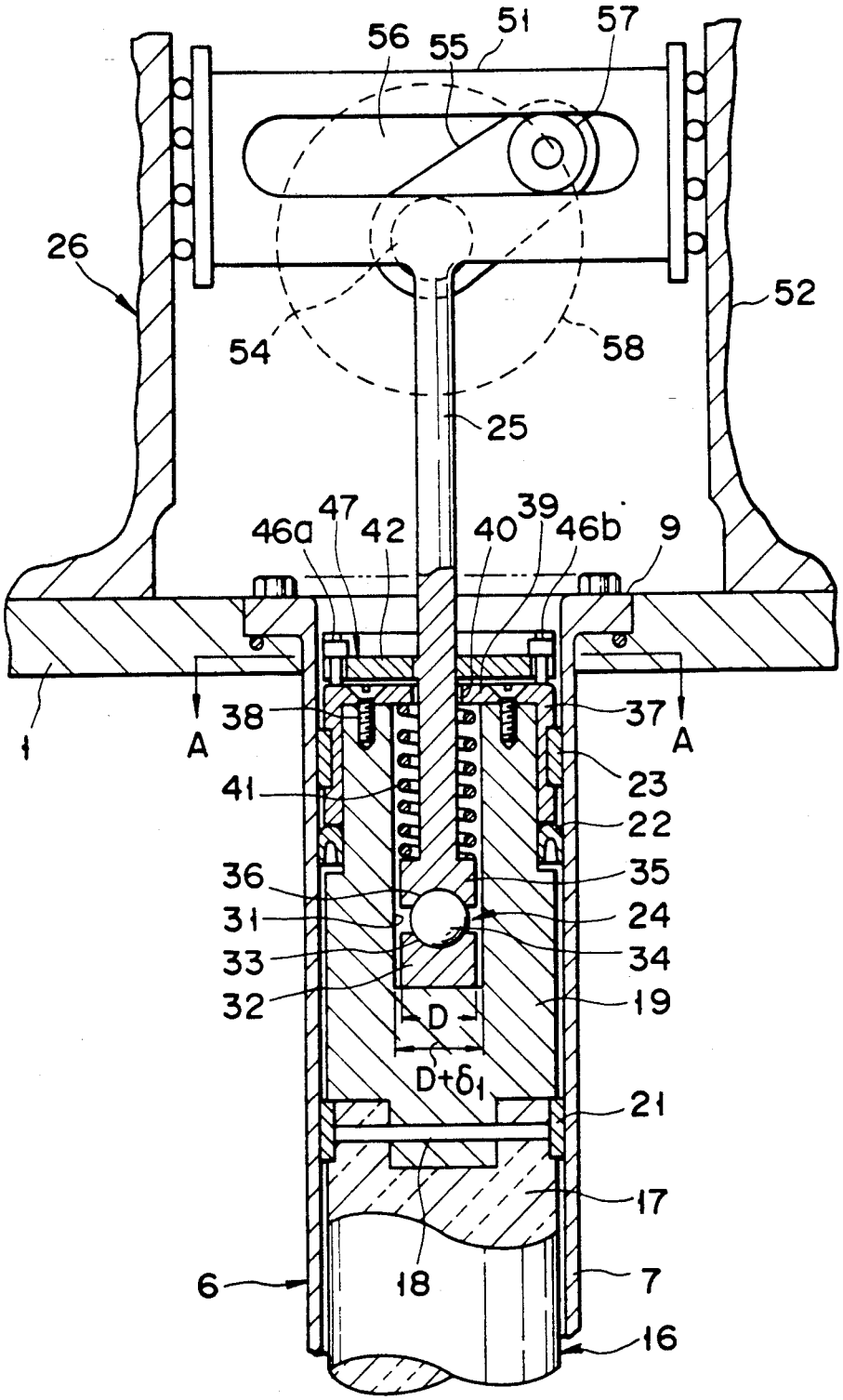
FIG. 2 is an enlarged view showing a ball-and-socket joint built in the gas expansion engine shown in FIG. 1.

The ball-and-socket joint 24 has a bottomed hole 31 of predetermined depth provided on the axis of the metal block 19 as shown in FIG. 2 in an enlarged form. The hole 31 is so formed as to have a cylindrical form with a diameter $(D+\delta_1)$ A ball receiving seat member 32 is so provided on the bottom of the hole 31 as to be slidable in a radial direction. The ball receiving seat member 32 is of a cylindrical configuration with a diameter D. A spherically curved receiving section 33 is provided on the upper surface of the ball receiving seat member 32 with a ball 34 placed on the upper surface of the ball receiving seat member 32. A large-diameter section 35 is provided on the lower end of the piston rod 25 and has a diameter of nearly D. A spherically curved receiving section 36 is provided on the lower surface of the large-diameter section 35. The ball 34 is sandwiched between the receiving sections 36 and 33 in a vertical direction.

A bottomed cap 37 is fixed by screws 38 to the upper end of the metal block 19 and a hole 40 is provided in the central portion of a bottom wall 39 of the cap 37 with the piston rod 25 loosely fitted in the hole 40. A coil spring 41 is provided between the bottom wall 39 of the cap 37 and the large-diameter section 35 and, by so doing, imparts an urging force to a contact surface between the receiving section 36 and the ball 34, contact surface between the ball 34 and the receiving section 33 and contact surface between the ball receiving seat member 32 and the inner surface of the bottom wall of the hole 31 so that the piston rod 25 is mechanically coupled to the metal block 19. The urging load so imparted by the coil spring 41 is set to a extent exceeding the sliding resistance of the piston 16.

Figure 3:
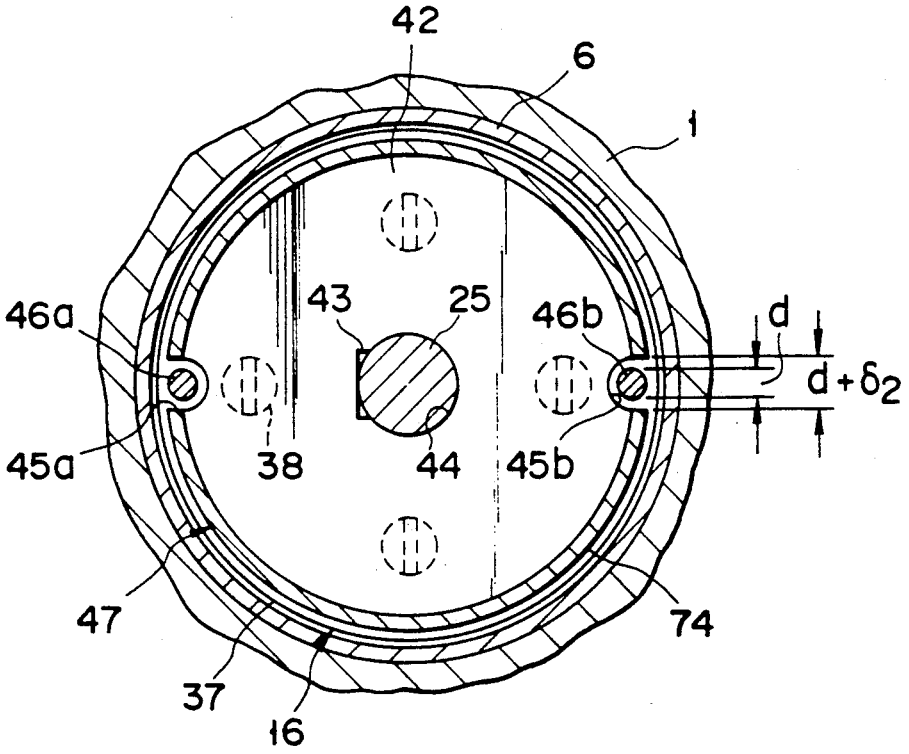
FIG. 3 is a cross-sectional view as taken along line A—A in FIG. 2.

A disc-like stopper 42 is non-rotatively fixed to the outer periphery of the piston rod 25 at that location defined above the cap 37 and has a diameter substantially the same as that of the piston 16. The stopper 42 has a part-circular hole 44, as shown in FIG. 3, into which a part-circular axial section 43 partially formed on the piston rod 25 is fitted to achieve a non-rotative state between the two. A projecting peripheral wall 74 is provided on the outer periphery of the stopper 42 to readily receive dirt and dust fallen from above. A pair of semi-circular cutouts 45*a*, 45*b* whose diameters have a value $(d+\delta_2)$ are oppositely provided on the outer peripheral portions of the stopper 42 across the part-circular hole 44, noting that the value $\delta_2$ is substantially equal to the aforementioned value $\delta_1$. In the cutouts 45*a* and 45*b* pins 46*a* and 46*b* of diameters d are fitted in a manner to be held erect on the outer surface of the bottom wall 39 of the cap 37. A rotation restriction mechanism 47 comprises the stopper 42, part-circular axial section 43, part-circular hole 44, cutouts 45*a* and 45*b*, pins 46*a* and 46*b* and is adapted to suppress an amount of rotation of the piston 16 to an extent below a predetermined value relative to the piston rod 25.

The other end of the piston rod 25 is coupled to the motion conversion mechanism 26 to convert the reciprocating motion of the piston rod 25 to a rotation motion. The motion conversion mechanism 26 comprises a grooved crosshead 51 reciprocating as one unit with the piston rod 25, guide mechanism 52 guiding the crosshead 51, crank arm 55 rotatably supporting the cranck shaft 54 on a stationary base 53, and slider 57 rotatably supported on the forward end portion of the crank arm 55 and fitted in the groove 56 of the crosshead 51. An electric generator 58 for power absorption is driven by the crank shaft 54.

An gas supply valve mechanism 61 and gas discharge valve mechanism 62 are provided between the piston 16 and the head wall 8 to open and close the gas intake port 10 and gas discharge ports 11 in interlock with the movement of the piston 16.

Figure 4:
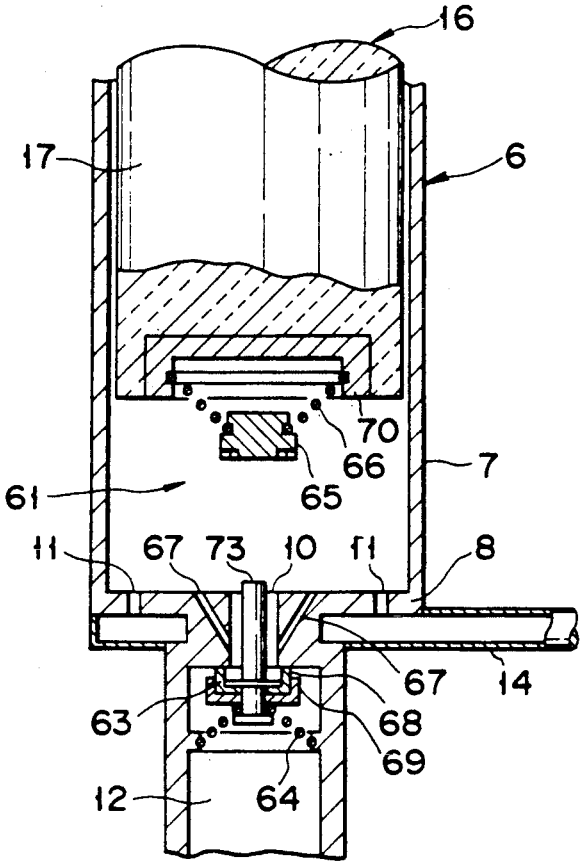
FIG. 4 is an enlarged view, in cross-section, showing a gas supply valve mechanism and gas discharge valve mechanism built in the gas expansion engine shown in FIG. 1.

The gas supply valve mechanism 61 comprises, as shown in FIG. 4 in enlarged form, a valve body 63 disposed within the small chamber 12 and adapted to open and close the gas intake port 10 from outside the head wall 8, a conical coil spring 64 normally urging the valve body 63 in a closed direction, a pushing member 65 provided on the forward end of the piston 16, a conical coil spring 66 adapted to normally urge the pushing member 65 in the direction of the head wall 8, a push rod 73 having one end fixed to the valve body 63 and the other end extending through the gas intake port 10 into the cylinder 6 and adapted to be pushed by the pushing member 65, when the forward end of the piston 16 is moved within a predetermined distance relative to the head wall 8, to allow the valve 63 to be opened, and a bypass passage 67 provided in the head wall 8 and adapted to allow the interior of the cylinder 6 to communicate with the small chamber 12, not via the open end of the gas intake port 10 at the inner side of the head wall 8, when the valve 63 is opened.

Figure 5:
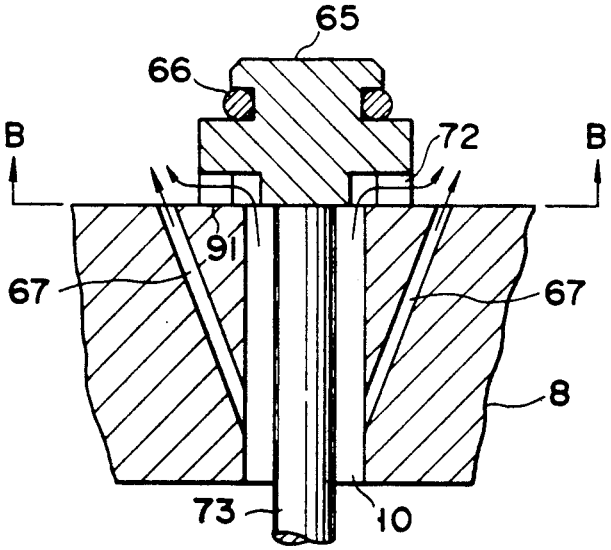
FIG. 5 is a cross-sectional view, partly enlarged, showing the gas supply valve mechanism of FIG. 4.
Figure 6:
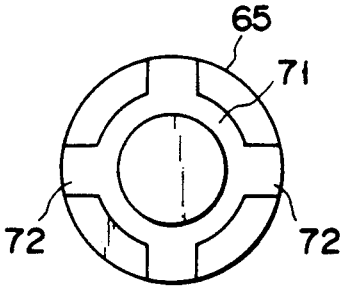
FIG. 6 is a view as taken along line B—B in FIG. 5.

The valve 63 comprises a sealing member 68 serving as the valve body and a support member 69 supporting the sealing member 68. The coil spring 66 is supported by a pan-like support member 70 buried in the forward end of the piston 16. The depth of the support member 70 is so set as to have a relevancy to the axial thickness of a support member 81 of the gas discharge valve mechanism 62 as will be set out below. The pushing member 65 is formed to have a diameter larger than that of the gas intake port 10. As shown in FIGS. 5 and 6, an annular groove 71 is formed in that end face of the pushing member 65 situated on the side of the head wall 8 and has an internal diameter smaller than the diameter of the gas intake port 10 and an external diameter greater than the gas intake port 10. A plurality of grooves 72, . . . , are formed in a radial array around the annular groove 71 and has one end communicating with the annular groove 71 and the other end opened at the outer periphery of the pushing member 65. As shown in FIG. 5 in enlarged form, the bypass passage 67 has one end opened partway at the axial inner surface of the gas intake port 10 and the other end opened at that area of the inner surface of the head wall B which is not brought into contact with the pushing member 65.

As shown in FIG. 1, the gas discharge valve mechanism 62 includes an annular valve operation member 81 situated between the lower end of the piston 16 and the head wall 8. An annular cavity, not shown, is provided in the inner portion of the valve operation member 81. Holes, not shown, are formed at that bottom wall of the annular cavity facing the gas discharge ports 11. A corresponding number of columnar valve bodies 82 are so fitted in the holes of the annular cavity that one end of each extends from within the cavity. The other end of the respective valve body 82 is supported, by a spring not shown, within the annular cavity. A groove is provided on the outer periphery of the valve operation member 81 and a slider 83, serving as a radial spring, is so held in the groove that it partially extends outwardly as will be seen from FIG. 1. The slider 83 is made of a self-lubricating material and is of such a type that it is of a half-split type with a partial cut on its outer periphery. Legs 84*a*, 84*b* are provided on the upper end edge portion of the valve operation member 81 in those positions radially corresponding to the valve operation member 81 and extend upwardly along the inner surface of the cylinder 6. Projections 85*a*, 85*b* are provided at the forward ends of the legs 84*a* and 84*b* such that they extend toward the axis of the piston body 17. Guide grooves 86*a* and 86*b* are formed in the outer periphery of the piston body 17 to guide the corresponding legs 85*a* and 85*b*. Deep grooves 87*a* and 87*b* are formed, in the up/down direction, in the grooves 86*a* and 86*b* over a predetermined length to guide the projections 85*a* and 85*b*.

A gas expansion engine thus constructed is operated as follows:

In the arrangement shown in FIG. 1, a top dead point is a point when the piston 16 is moved to the lowest end and a bottom dead point a point when it is moved to the uppermost end.

At a time point when the piston starts moving from the bottom dead point toward the top dead point, the gas discharge ports 11 are opened while the gas intake port 10 is closed. When a capacity in the expansion chamber 15 is decreased with the movement of the piston, a low-temperature and low-pressure gas in the expansion chamber 15 is discharged via the gas discharge ports 11 into the low-temperature gas guide tube 14. Upon the movement of the piston 16 to a given position, the inner edge portions of the upper ends of the deep grooves 87*a* and 87*b* abut against the projections 85*a* and 85*b*, respectively. As a result, the valve operation member 81, together with the piston 16, starts moving as one unit. With further movement of the piston 16 the valve bodies 82 are brought into contact with the inner surface of the head wall 8 to close the gas discharge ports 11. With still further movement of the piston 16 to a position near the top dead point, the valve bodies 82 are pushed with a strong force onto the inner surface of the head wall 8 to more completely close the gas discharge ports 11. At the same time, the pushing member 65 provided on the lower end of the piston 16 presses the push rod 73 downward. At a time point when the piston 16 is moved to a position immediately close to the top dead point, the valve body 63 is pushed downward, releasing the gas intake port 10. With the release of the gas intake port 10, a high-pressure gas is fed into the expansion chamber 15.

With the movement of the piston 16 past the top dead point, it starts moving toward the bottom dead point, while being pushed by the high-pressure gas. With further movement of the piston 16 by a given amount, the gas intake port 10 is closed by the valve body 63 and the piston 16 is still further moved toward the bottom dead point under the gas pressure. For this reason, there occur an abrupt increase in the capacity of the expansion chamber 15 and an attendant rapid fall in the gas pressure and temperature in the expansion chamber 15 at which time the gas discharge ports 11 are closed by the valve body 82.

With the continued movement of the piston 16 to a position closer to the bottom dead point, the expansion of the gas is terminated at which time the projections 85*a* and 85*b* are latched on the lower end edge portions of the deep grooves 87*a* and 87*b*. As a result, the valve operation member 81, together with the piston 16, starts moving as one unit toward the bottom dead point. With still further movement of the piston 16 to a given position, the valve body 82 is moved away from the head wall 8, so that the gas discharge ports 11 are released.

When the piston 16 reaches the bottom dead point, it is reversed in the direction of its motion under the rotational force (inertial force) by the motion conversion mechanism 26, starting a movement toward the top dead point. With the starting movement of the piston 16 toward the top dead point, the capacity of the expansion chamber 15 is decreased, discharging a low-pressure, low-temperature gas in the expansion chamber 15 via the gas discharge ports 11. In this way, the aforementioned operation is carried out in repeated fashion.

During the portion of the aforementioned operation, the reciprocatory movement of the piston 16 is converted by the motion conversion mechanism 26 to a rotation motion and the generator 58 is driven by the crank shaft 54 of the motion conversion mechanism 26.

In the gas expansion engine 5 according to the embodiment the piston 16 is coupled to the piston rod 25 by the ball-and-socket joint 24. For this reason, the piston 16 and piston rod 25 can be inclined relative to each other through the ball 34 and the ball receiving seat member 32 can be moved by an amount $\delta_1$ relative to the piston 16 in the radial direction. A full radial freedom is provided between the piston 16 and the piston rod 25 and, even if any positional displacement is produced between the axis of the cylinder 6 and that of the piston rod 25, the piston 16 and piston rod 25 can reciprocably be moved relative to the cylinder 6 and motion conversion mechanism 26, respectively, without imparting any undue force thereto. For this reason, any excessive lateral load can be prevented from being exercised over the sealing ring 22, guide ring 21 and so on, ensuring their longer service life. Upon the assembly of the cylinder 6 and motion conversion mechanism 26, they can readily be so done without high accuracy. Further, the piston 16 and piston rod 25 are pressure-coupled together under a force of the coil spring 41. Even if, therefore, these parts suffer an impact load resulting from a gas pressure involved upon the opening of the gas supply valve mechanism 61, their contact surface is difficult to elastically deform and, if being so done, it is possible to prevent any clatter noise there.

A rotation restricting mechanism 47 provided as shown in FIG. 2 can restrict, to an extent not exceeding a given value, the relative rotation of the piston 16 and piston rod 25 which is liable to be produced in the case where the piston 16 is coupled by the ball-and-socket joint 24 to the piston rod 25. For this reason, the valve bodies 82 are so maintained as to have a substantially constant positional relation to the gas discharge ports 11.

With the valve 63 opened, the bypass passage 67 allows the interior of the cylinder 6 to communicate with the small chamber 12. Even if any plastic deformation is produced in that impact area 91 (see FIG. 5), in particular, of the pushing member 65 so that a gas passage groove 72 becomes ineffective, positive communication can be achieved, by the bypass passage 67, between the interior of the cylinder 6 and the small chamber 12, enabling a stable operation to be performed over an extended period of time. It is, therefore, possible to stably maintain its engine performance for an extended period of time.

Figure 7:
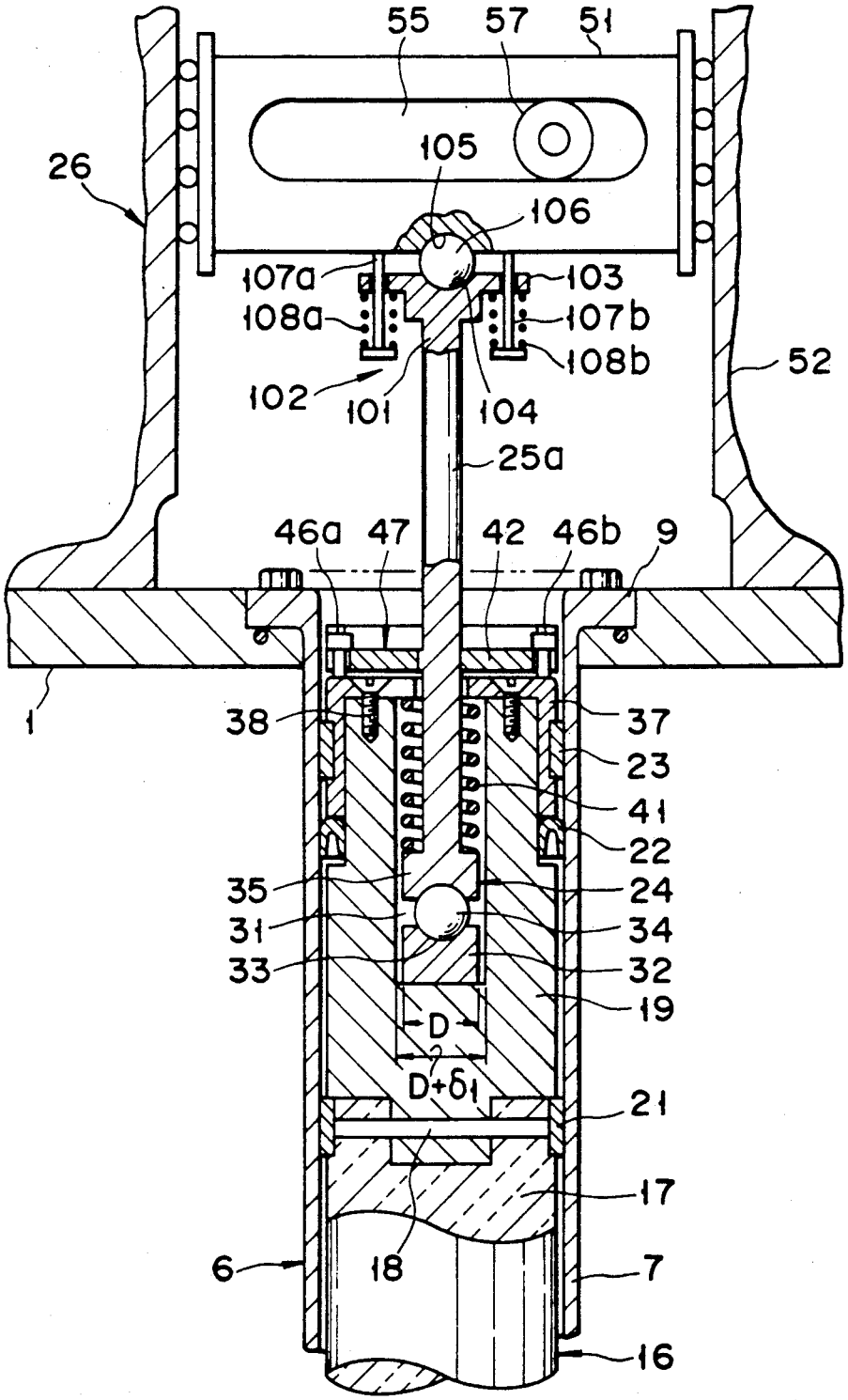
FIG. 7 is an enlarged view, partly broken away, showing a ball-and-socket joint built in a gas expansion engine according to another embodiment of the present invention.

FIG. 7 shows only a major section of a gas expansion engine according to another embodiment of the present invention. In FIG. 7 identical reference numerals are employed to designate parts or portions corresponding to those shown in FIG. 2 and any detailed explanation of them is omitted for brevity's sake.

An arrangement of FIG. 7 comprises the construction of FIG. 2 plus a ball-and-socket joint 102 provided between the top end 101 of the piston rod 25*a* and a grooved crosshead 51.

The ball-and-socket joint 102 comprises a flange portion 103 provided on the upper end 101 of the piston rod 25*a*, a spherically curved receiving surface section 104 provided on the top surface of the flange portion 103, a spherically curved receiving surface section 105 provided on the lower surface of the crosshead 51, a ball 106 placed between the receiving surface sections 104 and 105, pins 107*a* and 107*b* extending through the outer marginal edge portion of the flange portion 103 with a loosely fitted state and fixed to the crosshead 51, and coil springs 108*a* and 108*b* anchored between the flange portion 103 and pin heads of the pins 107*a* and 107*b*.

In this arrangement, the piston rod 25*a* is associated independently with both the piston 16 and the crosshead 51, thus being given a full degree of freedom in the radial direction while being restricted in the axial direction. Therefore, any motion of displacement, if being produced between the piston 16 and the crosshead 51, can be accommodated without involving any undue motion. The ball-and-socket joint 102 may be replaced with any other proper counterpart having the same function as that of the ball-and-socket joint 24.

Figure 8:
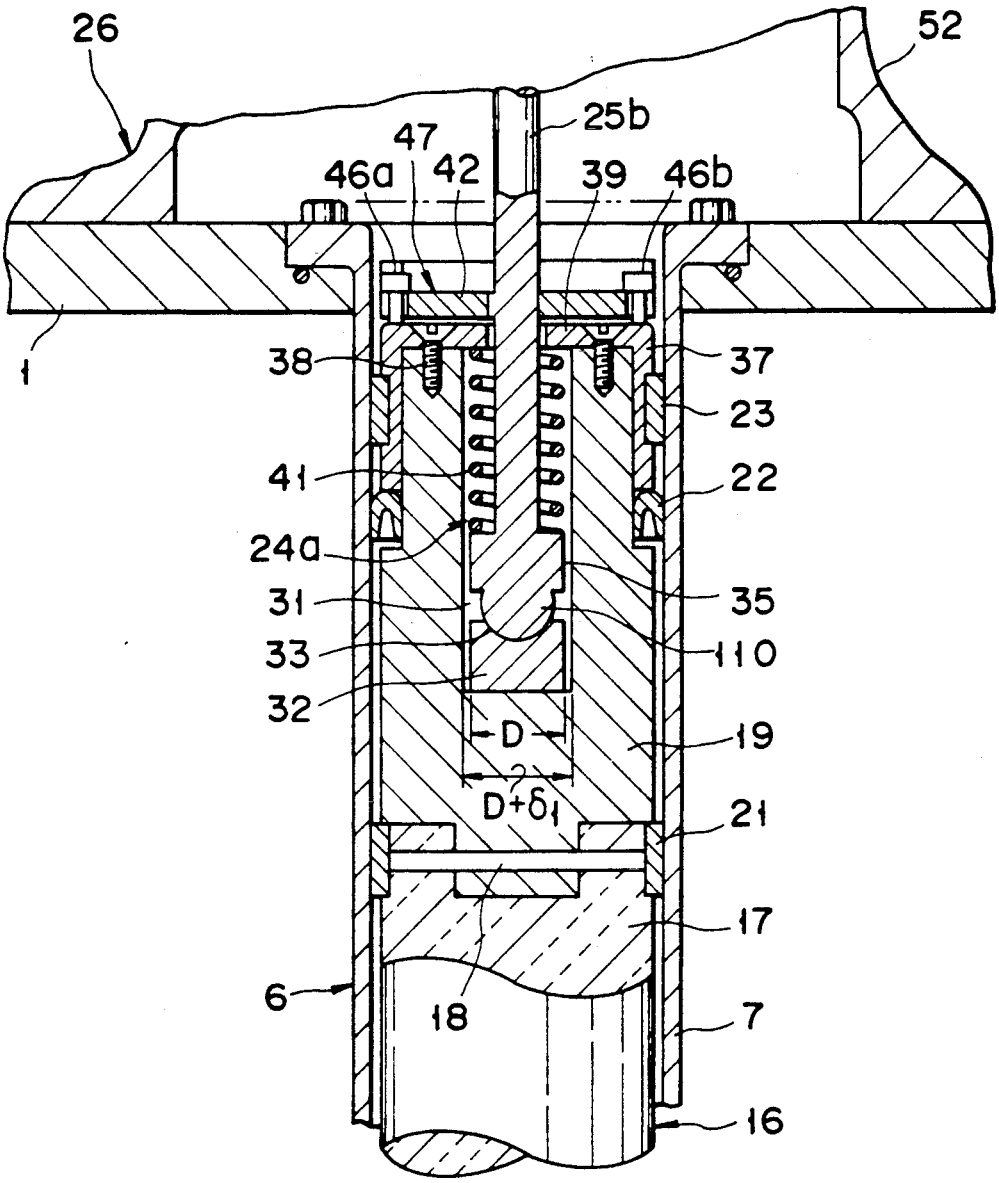
FIG. 8 is an enlarged view, partly broken away, showing a ball-and-socket joint in a gas expansion engine according to another embodiment of the present invention.

FIG. 8 shows a major section of a gas expansion engine according to another embodiment of the present invention. In FIG. 8, identical reference numerals are employed to designate parts or portions corresponding to those shown in FIG. 2 and any detailed explanation of them is omitted for brevity's sake.

In the embodiment shown in FIG. 8, an improved ball-and-socket joint 24*a* is provided between a piston 16 and a piston rod 25*b*.

In the embodiment shown in FIG. 8, a spherical ball section 110 is formed integral with a large-diameter section 35 provided on the lower end of the piston rod 25*b*. The spherical ball section 110 is supported on a corresponding spherical receiving surface section 33. This specific construction can exhibit the same function and advantage as those shown in FIG. 2. In this connection it is to be noted that the spherical ball section 110 may be provided on the spherical ball receiving surface section 33 side and the spherical ball receiving surface section 33 on the large-diameter section 35 side.

Figure 9:
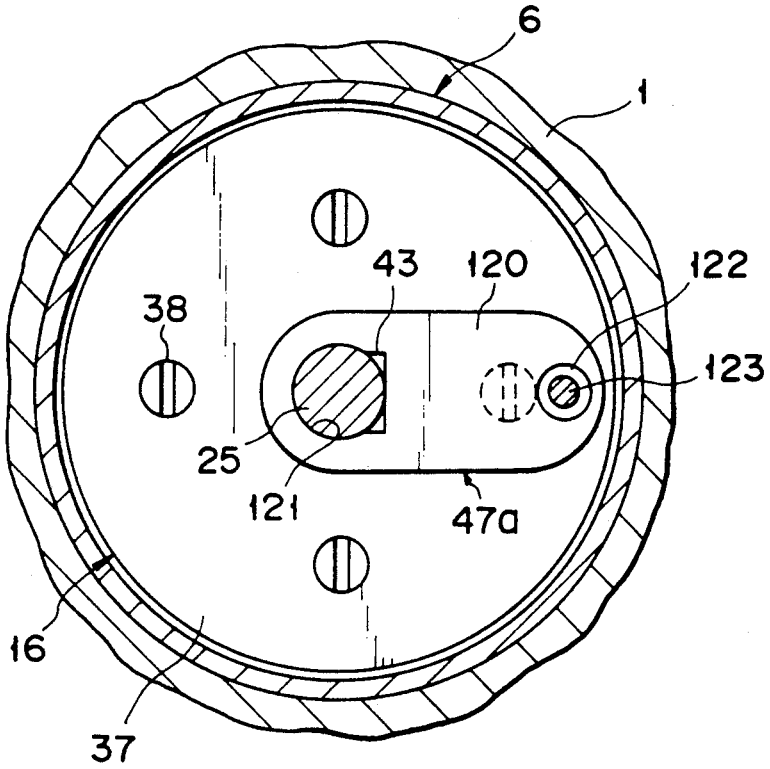
FIG. 9 is a cross-sectional view, partly taken away, showing a variant of the ball-and-socket joint corresponding to that of FIG. 3.

FIG. 9 shows a variant of the gas expansion engine of the present invention. In FIG. 9, identical reference numerals are employed to designate parts or portions corresponding to those shown in FIG. 3 and their detailed explanation is omitted for brevity.

FIG. 9 shows an improved variant showing a rotation restriction mechanism 47*a* for restricting the relative rotations of a piston 16 and piston rod 25.

The rotation restriction mechanism 47*a* includes an arm-like stopper 120 having a part-circular hole 121 at one end portion. A port-circular shaft section 43 is provided on the piston rod 25. A hole 122 is provided on the other end portion of the stopper 120 and a pin 123 is inserted into the hole 122 and fixed to a cap 37. The rotation restricting mechanism 47*a* exhibits the same function and advantage as those shown in FIG. 3.

Figure 10:
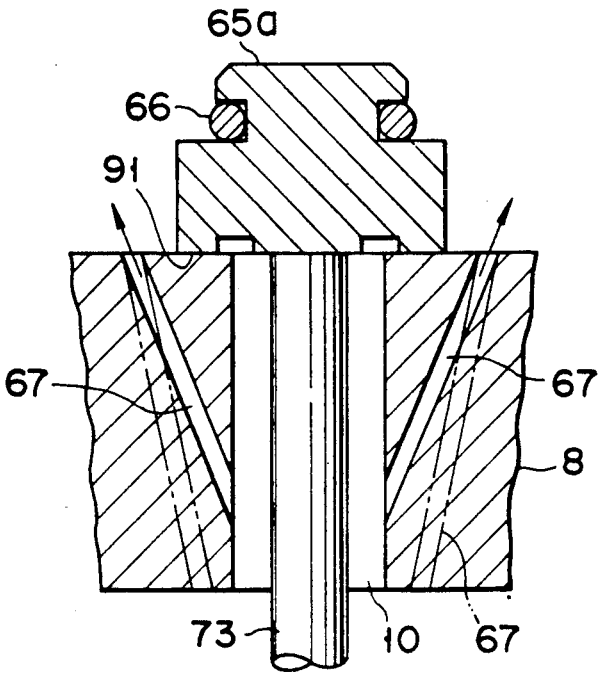
FIG. 10 is a cross-sectional view, partly enlarged, showing a variant of the gas supply valve mechanism in the preceding embodiment.

FIG. 10 shows a major section only of a gas expansion engine according to another embodiment of the present embodiment. In FIG. 10, identical reference numerals are employed to designate parts or elements corresponding to those shown in FIG. 5 and their detailed explanation is, therefore, omitted.

In an embodiment shown in FIG. 10, a groove for gas passage is not provided on that end face of a pushing member 65*a* facing a head wall 8. When, therefore, a piston reaches a top dead point, a push rod 73 is pushed by the pushing member 65*a* so that a valve 63 (see FIG. 4) is opened while, at the same time, the inside opened end of a gas intake port 10 is closed by the pushing member 65*a*. With the valve 63 so opened, a high-pressure gas is flowed into a cylinder 6 via the bypass passage 67. This specific construction can increase an area 91 of an impact of the pressing member 65*a* against the head wall 8 and hence decrease an involved pressure upon impact, thus retarding the progress of an elastic deformation. It is, therefore, possible to extend the life of the associated parts.

As indicated by the dash dot lines in FIG. 10, the bypass passage 67 may extend through any area of the head wall 8 so long as the small chamber side's open end of the bypass passage 67 is opened within the inner diameter range of the sealing member 68 (see FIG. 4) of the valve 63.

Figure 11:
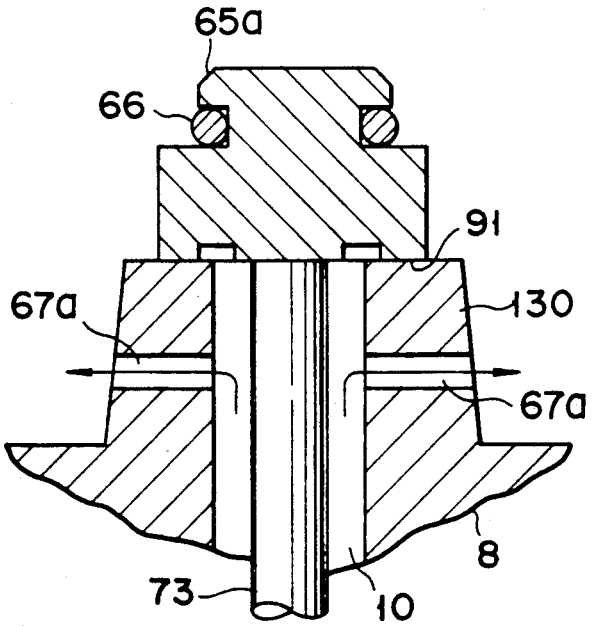
FIG. 11 is a cross-sectional view, partly enlarged, showing another variant of the gas supply valve mechanism in the preceding embodiment.

FIG. 11 shows only a major section of a gas expansion engine according to another embodiment of the present invention. In FIG. 11, identical reference numerals are employed to designate parts or portions corresponding to those shown in FIG. 10 and any further explanation of the parts is, therefore, omitted for brevity's sake.

In the embodiment shown in FIG. 11, a projection 130 is provided on the inner surface side of a head wall 8 and extends toward a piston with a gas intake port 10 penetrating the projection 130 from a small chamber 12 side. A pushing member 65*a* abuts against the top end surface of the projection 130 and a plurality of bypass passages 67*a* are provided in the peripheral wall of the projection 130. This embodiment can achieve the same function and advantage as set out in connection with the variant shown in FIG. 10.

Additional advantages and modifications will readily occur to those skilled in the art. Therefore, the invention in its broader aspects is not limited to the specific details, and illustrated examples shown and described herein. Accordingly, various modifications may be made without departing from the spirit or scope of the general inventive concept as defined by the appended claims and their equivalents.

What is claimed is:

1. A gas expansion engine comprising:

a cylinder including a head wall having a gas intake port and at least one gas discharge port;

means for enabling the gas intake port to communicate with a high-pressure gas supply source;

means for enabling the gas discharge port to communicate with a low-temperature gas discharge path;

a piston reciprocably inserted into the cylinder and defining a capacity-variable expansion chamber with the cylinder;

a piston rod connected at one end to the piston;

motion conversion means, connected to the other end of the piston rod, for converting a reciprocatory motion of the piston to a rotation motion;

gas supply valve means for opening the gas intake port, in a predetermined timing, in connection with a motion of the piston to allow the high-pressure gas to flow into the expansion chamber;

gas discharge valve means for opening the gas discharge port, in a predetermined timing, in connection with the motion of the piston to allow the low-temperature gas in the expansion chamber to flow into the discharge path;

energy absorption means for absorbing an energy of the rotation motion obtained by the motion conversion means; and ball-and-socket joint means provided at at least one of a location between the piston rod and the piston and a location between the piston rod and the motion conversion means, the ball-and-socket joint means including:

a first member having a spherically convex surface section;

a second member having a spherically concave surface section fitted in the spherically convex surface section and providing a joint boundary area with the first member;

means for slidably moving the first member or the second member in a direction perpendicular to an axis of the piston in accordance with an external force; and elastic means for providing a pressure contact force between the spherically convex surface section and the spherically concave surface section.

2. The gas expansion engine according to claim 1, wherein a vacuum adiabatic layer is provided around said cylinder.

3. The gas expansion engine according to claim 1, wherein said high-pressure gas is supplied from a high-pressure helium gas supply source.

4. The gas expansion engine according to claim 1, wherein an area of said piston provided on a piston head wall side is formed of an adiabatic material.

5. The gas expansion engine according to claim 1, wherein said motion conversion means comprises a guide mechanism, a grooved crosshead guided by the guide mechanism to allow only the reciprocatory motion to be done as one unit with said piston rod, a rotatable crank arm, and a slider mounted in the crank arm and fitted into the grooved crosshead.

6. The gas expansion engine according to claim 1, wherein said energy absorbing means includes an electric generator.

7. The gas expansion engine according to claim 1, wherein said ball-and-socket joint means includes rotation amount restricting means for restricting a relative rotation of said piston to said motion conversion means within a predetermined range.

8. The gas expansion engine comprising:

(1) a cylinder including a head wall having a gas intake port and at least one gas discharge port;

(2) means for enabling the gas intake port to communicate with a high-pressure gas supply source;

(3) means for enabling the gas discharge port to communicate with a low-temperature gas discharge path;

(4) a piston reciprocably inserted into the cylinder and defining a capacity-variable expansion chamber with the cylinder;

(5) a piston rod connected at one end to the piston;

(6) motion conversion means, connected to the other end of the piston rod, for converting a reciprocatory motion of the piston to a rotation motion;

(7) gas supply valve means for opening the gas intake port in connection with the motion of the piston to allow the high-pressure gas to flow into the expansion chamber, said gas supply valve means including:

(a) a valve body located outside the head wall to open and close the gas intake port;

(b) a first elastic member for normally urging the valve body in a closed direction;

(c) a pushing member disposed at the forward end of the piston;

(d) a second elastic member for normally urging the pushing member toward the head wall;

(e) a push rod having one end fixed to the valve body and the other end extending through the intake port into the cylinder, the push rod being of such a type that, when the forward end of the piston is moved within a predetermined distance relative to the head wall, it is pressed by the pushing member to open the valve body; and (f) a bypass passage provided in the head wall and adapted to, when the valve body is opened, enable the interior of the cylinder to communicate with the high-pressure supply source, not via an open end of the gas intake port which is provided on the inner surface side of the head wall, (8) gas discharge valve means for opening the gas discharge port, in a predetermined timing, in connection with the motion of the piston to allow the low-temperature gas in the expansion chamber to flow into the discharge path; and (9) energy absorption means for absorbing an energy of the rotation motion obtained by the motion conversion means.

9. A gas expansion engine according to claim 8, wherein a vacuum adiabatic layer is provided around said cylinder.

10. The gas expansion engine according to claim 8, wherein said high-pressure gas is supplied from a high-pressure helium gas supply source.

11. The gas expansion engine according to claim 8, wherein an area of said piston provided on a piston head wall side is formed of an adiabatic material.

12. The gas expansion engine according to claim 8, wherein said motion conversion means comprises a guide mechanism, a grooved crosshead guided by the guide mechanism to allow only the reciprocatory motion to be done as one unit with said piston rod, a rotatable crank arm, and a slider mounted in the crank arm and fitted into the grooved crosshead.

13. The gas expansion engine according to claim 8, wherein said energy absorbing means includes an electric generator.

14. The gas expansion engine comprising:

(1) a cylinder including a head wall having a gas intake port and at least one gas discharge port;

(2) means for enabling the gas intake port to communicate with a high-pressure gas supply source;

(3) means for enabling the gas discharge port to communicate with a low-temperature gas discharge path;

(4) a piston reciprocably inserted into the cylinder and defining a capacity-variable expansion chamber with the cylinder;

(5) a piston rod connected at one end to the piston;

(6) motion conversion means, connected to the other end of the piston rod, for converting a reciprocatory motion of the piston to a rotation motion;

(7) gas supply valve means for opening the gas intake port in connection with the motion of the piston to allow the high-pressure gas to flow into the expansion chamber, said gas supply valve means including:

(a) a valve body located outside the head wall to open and close the gas intake port;

(b) a first elastic member for normally urging the valve body in a closed direction;

(c) a pushing member disposed at the forward end of the piston;

(d) a second elastic member for normally urging the pushing member toward the head wall;

(e) a push rod having one end fixed to the valve body and the other end extending through the intake port into the cylinder, the push rod being of such a type that, when the forward end of the piston is moved within a predetermined distance relative to the head wall, it is pressed by the pushing member to open the valve body; and (f) a bypass passage provided in the head wall and adapted to, when the valve body is opened, enable the interior of the cylinder to communicate with the high-pressure supply source, not via an open end of the gas intake port which is provided on the inner surface side of the head wall, (8) gas discharge valve means for opening the gas discharge port, in a predetermined timing, in connection with the motion of the piston to allow the low-temperature gas in the expansion chamber to flow into the discharge path;

(9) energy absorption means for absorbing an energy of the rotation motion obtained by the motion conversion means; and

(10) ball-and-socket joint means provided at at least one of a location between the piston rod and the piston and a location between the piston rod and the motion conversion means, the ball-and-socket joint means including:

(a) a first member having a spherically convex surface section;

(b) a second member having a spherically concave surface section fitted in the spherically convex surface section and providing a joint boundary area with the first member;

(c) means for slidably moving the first member or the second member in a direction perpendicular to an axis of the piston in accordance with an external force; and (d) elastic means for providing a pressure contact force between the spherically convex surface section and the spherically concave surface section.

15. A gas expansion engine according to claim 14, wherein a vacuum adiabatic layer is provided around said cylinder.

16. The gas expansion engine according to claim 14, wherein said high-pressure gas is supplied from a high-pressure helium gas supply source.

17. The gas expansion engine according to claim 14, wherein an area of said piston provided on a piston head wall side is formed of an adiabatic material.

18. The gas expansion engine according to claim 14, wherein said motion conversion means comprises a guide mechanism, a grooved crosshead guided by the guide mechanism to allow only the reciprocatory motion to be done as one unit with said piston rod, a rotatable crank arm, and a slider mounted in the crank arm and fitted into the grooved crosshead.

19. The gas expansion engine according to claim 14, wherein said energy absorbing means includes an electric generator.

20. A gas expansion engine according to claim 14, wherein said ball and joint means includes a rotation amount restricting means for restricting a relative rotation of said piston to said motion conversion means within a predetermined range.

* * * * *